United States Patent [19]

Karll

[11] 4,178,771

[45] Dec. 18, 1979

[54] COMPRESSOR REFRIGERATOR

[75] Inventor: Bent Karll, Augustenborg, Denmark

[73] Assignee: Danfoss A/S, Nordborg, Denmark

[21] Appl. No.: 897,584

[22] Filed: Apr. 19, 1978

[30] Foreign Application Priority Data

Apr. 18, 1977 [DE] Fed. Rep. of Germany ..... 2717050

[51] Int. Cl.[2] ..... F25B 41/06

[52] U.S. Cl. ..... 62/200; 62/204

[58] Field of Search ..... 62/199, 200, 525, 204, 62/117

[56] References Cited

U.S. PATENT DOCUMENTS

| | | | |
|---|---|---|---|
| 2,128,020 | 8/1938 | Smilack | 62/199 |
| 3,003,333 | 10/1961 | Lysen | 62/199 |

*Primary Examiner*—William E. Wayner

*Attorney, Agent, or Firm*—Wayne B. Easton

[57] ABSTRACT

The invention relates to controls for a refrigeration assembly of the type having freezer and utility compartments with the freezer compartment having the greater cold requirement. The compartment evaporators are in parallel fluid flow lines with an electrically operated blocking device such as a PTC resistor being in the utility compartment line. Thermostats in the two compartments control the flow of refrigerant to the two compartments in a manner such that at the beginning and end of a cycle both compartments are supplied with refrigerant fluid while during the middle part of the cycle only the freezer compartment is supplied with refrigerant fluid.

2 Claims, 2 Drawing Figures

COMPRESSOR REFRIGERATOR

Figure 1:
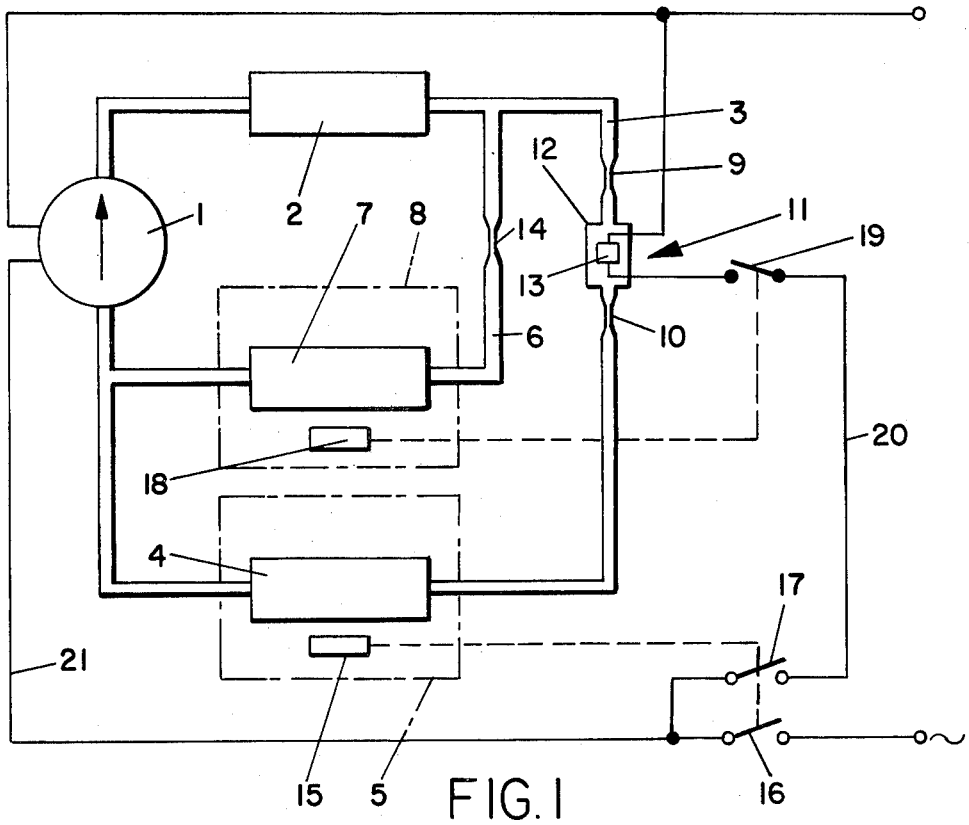

The invention relates to a compressor refrigerator comprising two compartments of different temperature of which the evaporators are connected substantially in parallel and fed by a common compressor and condenser, a first thermostat controlling the compressor in the one compartment and a second thermostat controlling in the other compartment a blocking device, particularly a PTC resistor arranged in a chamber, which blocking device is disposed upstream of the inlet of the evaporator of the compartment having the higher temperature.

In a known refrigerator of this kind, the first thermostat controlling the compressor is disposed in the compartment of lower temperature. This takes into account the circumstance that the compressor must be permanently operated when necessary, for example when the compartment is charged with fresh goods. In order that the compartment of higher temperature is not refrigerated excessively during this time, the second thermostat disposed in this compartment controls the current supply to a heating resistor adjacent a capillary tube. When a vapour plug is formed as a result of heating the capillary tube, the supply to the evaporator in the compartment of higher temperature is blocked.

According to a previous suggestion, such a refrigerator can also employ a blocking device consisting of a chamber containing a PTC resistor which, when passing a temperature range between the evaporating temperature of the refrigerant associated with the pressure in the chamber and the coking temperature of the refrigerant oil goes from a lower to a higher resistance. In this way a blocking effect is again achieved by the formation of vapour, but this time without excessive heating.

When the compartment of lower temperature has been brought to the nominal temperature, there is good insulation and no heat is supplied by opening a door or the like, it can happen that the standstill periods of the compressor become large and the compartment of higher temperature is inadequately refrigerated.

The invention is based on the problem of providing a compressor refrigerator of the aforementioned kind in which both compartments are refrigerated to the required extent.

This problem is solved according to the invention in that the first thermostat controlling the compressor is disposed in the compartment of higher temperature and the second thermostat controlling the blocking device is disposed in the compartment of lower temperature and operates the blocking device when an upper limiting value of the lower temperature is exceeded.

With this construction, the compressor is switched on and off depending on the temperature in the compartment of higher temperature. This gives comparatively short standstill periods as are usual in refrigerators having only one compartment. If refrigerating effect is required in the compartment of lower temperature, the blocking device responds. If, now, the compressor operates by reason of the temperature in the compartment of higher temperature, it remains in operation continuously because the temperature in the compartment of higher temperature does not drop on account of blocking the supply of refrigerant. Only when the second thermostat switches the blocking device off because of the temperature in the compartment of lower temperature will the temperature in the compartment of higher temperature drop until the compressor is finally switched off. Thus, although the compressor is controlled by the compartment of higher temperature there is a marked control in response to the compartment of lower temperature.

It is particularly favourable if the first thermostat comprises a main contact which has a switching difference and is in series with the compressor, and an auxiliary contact which has a switching difference, is in series with the contact of the second thermostat and switches on when the temperature falls below a temperature which is somewhat higher than the switching-off temperature of the main contact. The result of this is that the blocking device only becomes effective when the compartment of higher temperature has assumed a comparatively low temperature. There is therefore sufficient time available for also producing more refrigeration in the compartment of lower temperature. The compressors can therefore be designed to be correspondingly small.

In a preferred embodiment, it is also ensured that the auxiliary contact switches off on exceeding a temperature somewhat higher than the switching-on temperature of the main contact. This feature is recommended if excessively high temperatures are to be avoided with certainty in the compartment of higher temperature. If, for example, heat penetrates the compartment of higher temperature by the opening of a door whilst the blocking device is effective, the blocking device can be switched off so that the compressor, which continues to run, serves both evaporators simultaneously until the compartment of higher temperature has been adequately cooled and the auxiliary contact again switches on, whereupon the entire refrigeration effect is provided for the compartment of lower temperature.

In addition, the main contact can also be in series with the contact of the second thermostat. This is recommended when the blocking device comprises a heating element such as a PTC resistor. It will be ensured that heat is supplied only when the compressor is also in operation, i.e., the dissipation of heat by the refrigerant is also possible.

Figure 2:
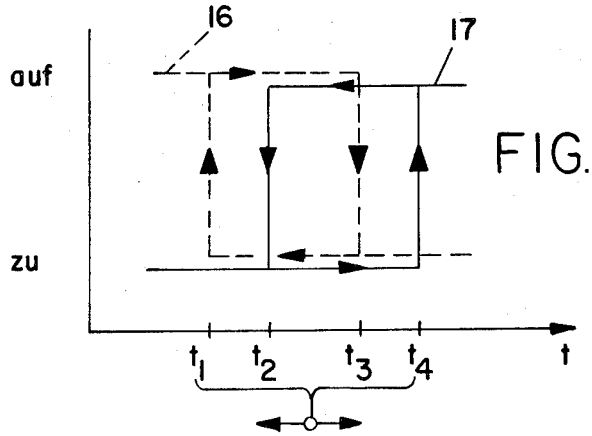

The invention will now be described in more detail with reference to an example illustrated in the drawing, wherein:

FIG. 1 is a diagrammatic circuit diagram of a compressor refrigerator according to the invention, and FIG. 2 is a diagram showing the switching conditions of the main and auxiliary contact of the first thermostat.

The refrigerator comprises a compressor 1 and a downstream condenser 2. This feeds a parallel circuit of an evaporator 4 in a compartment 5 of higher temperature by way of a first conduit 3 and an evaporator 7 in a compartment 8 of higher temperature by way of a conduit 6. Between two throttling points 9 and 10 in the conduit 3 there is a blocking device 11 comprising a PTC resistor 13 disposed in a chamber 12. A throttling point 14 is located in the conduit 6.

In the compartment 5 of higher temperature there is a thermostat 15 or the sensor of this thermostat; it controls a main contact 16 and an auxiliary contact 17. In the compartment 8 of lower temperature there is a thermostat 18 or its sensor; it controls a contact 19. The latter forms a series circuit 20 with the PTC resistor 13 and the auxiliary contact 17, which circuit is in parallel with the lead 21 of the compressor motor. Both are applied to an AC voltage with the aid of the main switch 16.

FIG. 2 shows the switching condition of the main contact 16 and auxiliary contact 17 above the temperature of the compartment 5. The main contact opens when the temperature drops below the switching-off temperature $t_1$. It remains open until the switching-on temperature $t_2$ is exceeded. Since the compressor 1 is switched on with the aid of the main contact 16, one in this way obtains intermittent cooling by which the compartment 5 is maintained within the temperature range between the temperatures $t_1$ and $t_2$, for example 5° C. For example, the compressor is switched on twelve times per hour and then runs for about one minute. The standstill periods are therefore comparatively short. The compartment 8 of lower temperature also receives a certain amount of refrigeration during this time and this is in any case adequate for keeping the temperature of the compartment below a desired limiting value. Since this compartment is generally a freezer compartment, only the upper limiting value is of interest; lower temperatures are harmless.

If the temperature in the compartment 8 exceeds an upper limiting value, the contact 19 closes. Provided that the main contact 16 and auxiliary contact 17 are closed, the PTC resistor 13 is heated. Refrigerant vapour is produced in the chamber 12. The conduit 3 thereby becomes blocked. The entire refrigeration effect reaches the evaporator 7 in the compartment 8 of lower temperature. Since the temperature in the compartment 5 now no longer drops, the compressor 1 also remains in operation. It runs until the contact 9 opens again because the compartment 8 has again reached the correct temperature. Only then will the blocking device 11 open so that the compartment 5 is cooled until the compressor is finally switched off by opening the main contact 16.

The auxiliary contact 17 closes when the temperature in the compartment 5 drops below the value $t_3$ which is somewhat higher than the switching-off temperature $t_1$ of the main contact 16, for example by 2° C. This ensures that the blocking device 11 can, after the thermostat 18 has responded, become effective only when the temperature in the compartment 5 is near the lower limiting value. There is therefore an adequate time interval during which the compressor 1 refrigerates only the compartment 8 before the temperature in the chamber 5 has risen excessively.

The auxiliary contact 17 opens when the temperature in the chamber 5 has exceeded a value $t_4$ which is somewhat higher than the switching-on temperature $t_2$ of the main contact 16, for example by 2° C. The result of this is that the blocking device 11 becomes effective when, because of the blocking, the temperature in the compartment 5 assumes excessively high values, for example because the door was opened in the meantime. In this case the normal operating condition would be attained for a short period at which both compartments are refrigerated. Only when the auxiliary contact 17 again closes at the temperature $t_3$ will refrigeration of the compartment 8 continue alone as the compressor 1 continues to run.

Heating of the PTC resistor 13 depends on the position of the contact 16, the auxiliary contact 17 and the main contact 16. This ensures that heating will take place only upon the cumulative occurrence of three conditions, namely an insufficient temperature in the compartment 8, an insufficient temperature in the compartment 5 and operation of the compressor 1. The latter ensures that the blocking device is automatically inoperative whenever there is no refrigeration, that is to say when no blocking is necessary.

As is indicated by the arrows in FIG. 2, the temperature $t_1$ and $t_4$ can be adjusted with the aid of a conventional desired value setting device.

By way of example, the refrigerator is part of a refrigerating cabinet having a refrigerating compartment 5 and freezer compartment 8.

I claim:

1. A refrigeration assembly, comprising, first and second compartments having lesser and greater cold requirements, compressor and condenser means in fluid flow series, first and second evaporator means in said compartments, first and second parallel conduit means extending from said condenser means to said first and second evaporator means, electrically operated blocking means in said first conduit means, a parallel circuit having first and second conductor means for said blocking means and said compressor means, a main switch in series with said parallel circuit, a blocking switch in series with said blocking means, and first and second thermostats for said compartments for operating said main switch and said blocking switch.

2. A refrigeration assembly according to claim 1 including an auxiliary switch in series with said blocking switch operated by said first thermostat, said main and auxiliary switches each having different opening and closing temperature characteristics, said main and auxiliary switches sequentially closing and opening during a rise in temperature in said first compartment and sequentially closing and opening during a fall in temperature in said first compartment.

* * * * *